United States Patent [19]

Aubert

[11] Patent Number: 4,661,014

[45] Date of Patent: Apr. 28, 1987

[54] PREFABRICATED CIVIL ENGINEERING MODULE, METHOD FOR THE CONSTRUCTION OF A STRUCTURE INCLUDING SAID MODULE AND RESULTING STRUCTURE

[75] Inventor: Jean Aubert, Paris, France

[73] Assignee: Groupement d'Interet Economique, Puteaux, France

[21] Appl. No.: 678,571

[22] Filed: Dec. 4, 1984

[30] Foreign Application Priority Data

Dec. 23, 1983 [FR] France ..... 83 20666

[51] Int. Cl.[4] ..... E02B 7/08; E02B 7/14; E02B 3/06

[52] U.S. Cl. ..... 405/111; 405/21; 405/114

[58] Field of Search ..... 405/13, 14, 16, 19, 405/20, 21, 23, 25, 31, 33–35, 87, 107, 108, 110, 111, 112, 114, 116, 117, 171, 195, 262, 273, 284, 286, 203, 205, 206

[56] References Cited

U.S. PATENT DOCUMENTS

| | | | |
|---|---|---|---|
| 137,659 | 4/1873 | Cunningham . | |
| 231,957 | 9/1880 | Dyer | 405/21 |
| 478,154 | 7/1892 | Carson . | |
| 690,840 | 1/1902 | Daime . | |
| 1,075,229 | 10/1913 | Smith . | |
| 1,189,214 | 6/1916 | Spelman . | |
| 1,310,461 | 7/1919 | Williams . | |
| 1,489,428 | 4/1924 | Cushing | 405/21 |
| 1,902,741 | 3/1933 | Weber | 405/114 X |
| 2,014,116 | 9/1935 | Powers . | |
| 2,017,899 | 10/1935 | Gibson . | |
| 2,063,514 | 12/1936 | Meem . | |
| 2,133,256 | 10/1938 | Stewart et al. | 405/112 |
| 2,653,450 | 9/1953 | Fort | 405/287 |
| 2,705,403 | 4/1955 | Ebert . | |
| 2,966,778 | 1/1961 | Quirn . | |
| 3,335,572 | 8/1967 | Tsujioka . | |
| 3,538,711 | 11/1970 | Nielsen | 405/23 |
| 3,640,075 | 2/1972 | La Peyre . | |
| 3,889,476 | 6/1975 | Gerin . | |
| 3,922,864 | 12/1975 | Hilfiker | 405/262 |
| 3,990,247 | 11/1976 | Palmer . | |
| 4,229,123 | 10/1980 | Heinzmann | 405/286 X |
| 4,297,052 | 10/1981 | Rankin . | |

FOREIGN PATENT DOCUMENTS

| | | | |
|---|---|---|---|
| 686429 | 9/1966 | Belgium . | |
| 1500930 | 10/1967 | France . | |
| 2379650 | 9/1978 | France . | |
| 2422774 | 11/1979 | France . | |
| 589318 | 3/1959 | Italy | 405/112 |
| 77413 | 6/1981 | Japan | 405/35 |
| 15045 | of 1906 | United Kingdom | 405/114 |
| 676082 | 7/1952 | United Kingdom | 405/25 |
| 848900 | 9/1960 | United Kingdom | 405/262 |
| 2078833 | 1/1982 | United Kingdom . | |
| 844660 | 7/1981 | U.S.S.R. | 405/117 |

*Primary Examiner*—Cornelius J. Husar
*Assistant Examiner*—Nancy J. Stodola
*Attorney, Agent, or Firm*—Young & Thompson

[57] ABSTRACT

System for the construction and utilization of multitubular structures called modules A, whose joined elements (2) have a cylindrical or prismatic shape. The dimensions (L, l) transversely to the axis (X—X) of the elements (2) are greater than the dimension (h) along this axis (X—X). Several joined modules constitute a line of modules, used to close off a river. Several lines of modules can be superimposed to build an overspill structure of a certain height. Structure is provided to float a line of modules into place above its sinking site. Modules can also be used advantageously for certain works built on dry ground.

11 Claims, 18 Drawing Figures

PREFABRICATED CIVIL ENGINEERING MODULE, METHOD FOR THE CONSTRUCTION OF A STRUCTURE INCLUDING SAID MODULE AND RESULTING STRUCTURE

BACKGROUND OF THE INVENTION

1. Field of the Invention

The present invention concerns a prefabricated civil engineering module, its application to the construction of a structure, and the resulting structure such as a river closure, a dam, barrage or weir, a lock chamber wall, coastal works and similar.

The prefabricatd structure concerned by the invention, or a multitubular type, as will be seen, will for greater simplicity be called a "module" in the following description and claims.

2. Description of the Prior Art

It is known that to achieve a closure, in other words a structure set up across a river stretching from one bank to the other in order to raise the water level upstream, a known method consists in dumping rocks simultaneously over the entire width of the river and in progressing from the bottom up to the surface. Then what is known as a horizontal closure is achieved.

It is also known that when such a closure is achieved, the slope of the downstream face of the structure increases with the weight of the rockfill materials used and the result is that the length and volume of the structure decrease under the same conditions.

Furthermore, when a closure is carried out, it is sought to distribute equally the materials over the whole length of the structure in order to avoid the formation of a low point. In effect, the force of erosion increases with water depth and a local lowering of the crest of the structure therefore tends to increase this force of erosion. One is then in the presence of an unstable phenomenon and if the arrival of the materials added to raise the low point takes too long, these materials are washed away and are deposited on the downstream slope, erosion continuing in this case until the downstream slope of the closure structure has become very low. It is then necessary to use a very large quantity of rockfill materials to reestablish the original level of the structure.

Nevertheless, the regular installation over the entire width of a river of very heavy blocks, whether what is involved are natural rockfills or artificial rockfills such as prefabricated concrete blocks, raises great difficulties. In effect, the simultaneous or almost simultaneous routing of heavy rockfill materials over the entire length of the closure line is very difficult to achieve and generally requires the use of very costly intallations.

SUMMARY OF THE INVENTION

One of the objects of the present invention is to achieve an assembly constituting an indivisible heavy block, likely to replace economically a concrete block acting by its weight, this assembly being arranged in such a way as to constitute a structure such as closure, a dam, barrage or weir, a bridge abutment, a lock chamber wall, or similar, which is not moved, even by a strong current.

Another object of the invention is to achieve a structure which can be several tens of meters in height and weigh several hundred or thousand tons, while only using small quantities of a noble material such as steel.

In order to achieve these objects, a civil engineering module is provided according to the invention, characterized in that it consists of several rigid tubular elements joined together and comprising filling orifices.

Hence, each module made of steel sheet or of a similar material, constitutes a voluminous but light structure that can be installed easily. Furthermore, the structure made with one or several modules joined together is substantially horizontal and can be filled progressively with a heavy material.

In an advantageous embodiment, the tubular elements are joined up along at least one row extending transversely to the axis of the elements and the dimensions of the organ transversely to the axis of the elements are greater than its dimension along this axis. Hence, the overall structure has a considerable stability when it is set in place.

In a particular embodiment, the tubular elements are straight cylinders with a circular base and this arrangement provides for a low deformation of the tubular elements when the rockfill material is introduced.

According to another advantageous embodiment of the invention, the tubular cylindrical elements have a triangular base and the structure is easily achieved by associating zig-zag bent sheets with flat sheets. In particular, the zig-zag bent sheets comprise a succession of W-sheets placed end to end, separated by parallel flat sheets, the cellular assembly thus obtained being completed by a plating extending along the length of the module and constituting its walls.

According to further constituting features of the invention, each module comprises means to allow it to float temporarily on the water. Preferentially, these means consist of inflated balloons placed inside the tubular elements, or membranes stretched across the opening of the elements. These floating means are preferably placed at the base of the tubular elements so that the module has a low draught when it floats. A means for simultaneously puncturing all the floating means, for example explosive bolts placed on each membrane or each balloon, and actuated remotely is furthermore provided to allow the module to sink rapidly into its closure position by the abrupt puncturing of the floating means.

By way of example, the closure method comprises the following steps: a rockfill base is made with a substantially horizontal surface over the entire width of the river, onto this base is sunk a line of modules comprising at least one module in such a manner that the tubular elements of each module are arranged in a substantially vertical manner, and the tubular elements of each module are filled with heavy materials.

According to an advantageous version of the method according to the invention, each module is floated to above the sinking site and this sinking is caused while keeping the axes of the tubular elements substantially vertical by the simultaneous puncturing of the floating means over the whole surface of the line of modules. In particular, a floating line of organs extending over virtually the entire width of the river is achieved by placing several modules end to end and joining them together. The floating line of modules thus obtained is held in place by mooring cables would on winches placed upstream of the sinking site and it is allowed to drift under the effect of the current while controlling the payout of the mooring cables until the line of modules reaches the sinking site. Finally, the balloons or membranes are punctured simultaneously.

Such a method makes it possible to achieve a structure to close off a river even when the river is not at its low level.

According to other features of the method, several lines of organs are successively superimposed, each line of modules being filled with heavy materials before the following line of modules is put in place; a backfill upstream of each line of modules is carried out after filling and the successive lines of modules are sunk in an offset fashion with respect to each other in the upstream direction starting from the base of the closure, the whole thus taking on the appearance of a staircase.

According to one aspect of the invention, a structure is made comprising at least one module, the tubular elements of the module being installed in a substantially vertical fashion and filled with a heavy material.

According to another advantageous embodiment, a structure includes several lines of modules, at least partially superimposed, a backfill being carried out on one side of each line of modules, and the lines of organs situated at different levels being offset with respect to each other.

BRIEF DESCRIPTION OF THE DRAWINGS

Other characteristics and advantages of the invention will result from the following description of nonlimitative examples with reference to the accompanying drawings, in which.

DESCRIPTION OF THE PREFERRED EMBODIMENTS

Figure 1:
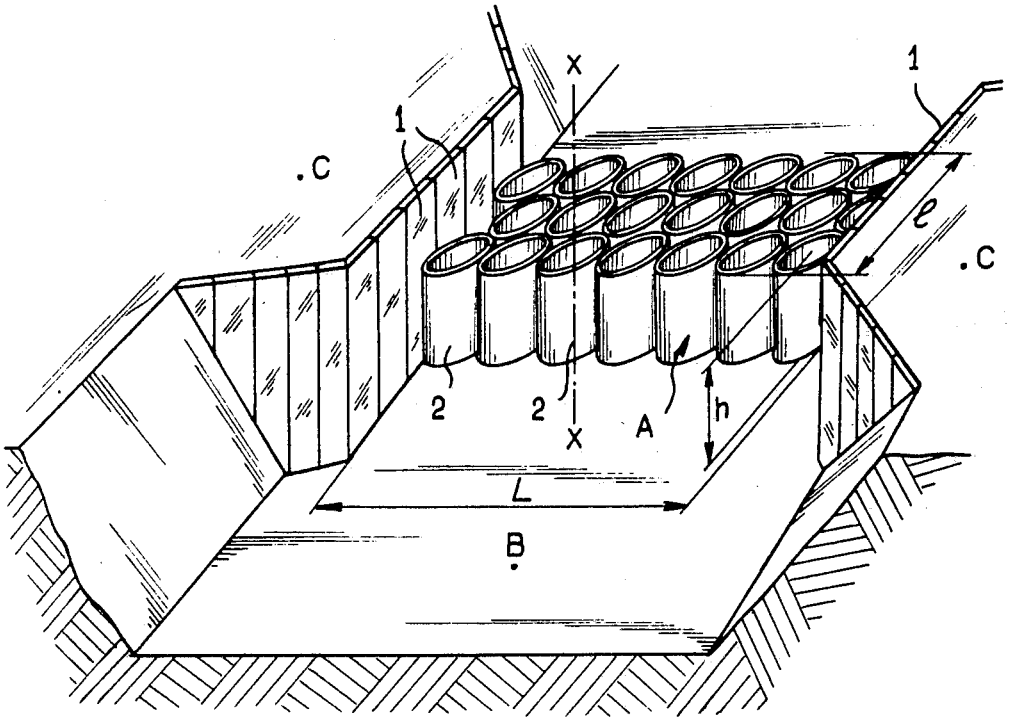
FIG. 1 is a perspective view of a module-type closure according to the invention installed in a dry river bed.

FIG. 1 shows, according to a perspective view, a module A according to the invention installed in a river B momentarily considered to be dry. To ensure the securing of module A, the banks C of the river have been dug out in order to provide a channel of substantially constant width and of a height which is adequate to contain the river in high-water periods.

At the level of the closure, the banks C are supported by sheetpile walls 1.

In this example, the module A comprises a series of tubular elements 2 which are cylindrical and parallel to each other, with a circular base joined and welded to each other along the generatrices. Each tubular element can for example be made using 3 mm thick steel sheet, 2 meters high and 4.41 meters long allowing a 1.5-meter diameter cylinder to be obtained by bending the sheet and welding the two end edges placed in contact with each other. In the example considered, the module A comprises several rows of tubular elements 2 joined parallel to each other, the rows extending transversely in the axis X-X of the elements 2 and constituting an indivisible module whose dimensions (L, l) transverse to the axis X-X of the elements are greater than the dimension (h) along this axis. On the module shown, all the elements have the same length and the organ therefore has substantially the form of a parallelipiped whose large side is placed perpendicular to the banks C. The tubular elements 2 are open at their two ends, the said ends are located in the two parallel planes, orthogonal to the axes of these elements.

In the case of an installation in a momentarily dry river, the module can either be built on one bank of the river and then installed by suitable means, or be built directly in the bed of the river.

Once the module has been installed in the river, the cylindrical elements are filled with heavy material such as broken stones or gravel.

Hence, even if the tubular elements 2 are not all completely filled, the weight of the assembly is adequate to maintain the modules in place in the river flow and this module offers transversely to the river an upper edge which is substantially horizontal so that at no point is there an acceleration of the river flow which could give rise to disorders.

Tubular elements with circular base offer the advantage of not deforming when they are filled with heavy materials. But in the case of a closure made with a module according to the invention, even quite considerable deformations are not particularly bothersome and it is possible to replace the circular base cylinders by prisms, in particular with a triangular base, allowing module to be obtained more easily.

Figure 2:
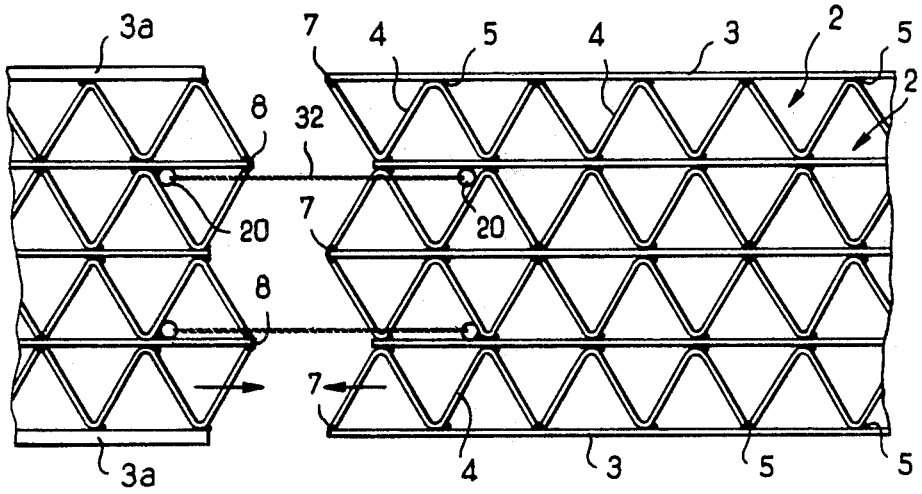
FIG. 2 is a partial top view of two modules comprising tubular elements with a triangular base.

FIG. 2 shows a top view of a module comprising tubular elements of this type forming a set of prismatic elements with a triangular base. The module is then made up of a series of flat sheets 3 between which are placed zig-zag sheets, and more particularly W-sheets 4 connected to the flat sheets by welding beads 5. In this case, the bent sheets can be brought to the jobsite already bent.

FIG. 2 shows a partial view of two adjacent modules comprising complementary ends 7 and 8. It can be seen that these ends 7 and 8 can either bear directly on the banks of a river, or be fitted one inside the other so as to obtain a line of modules offering a certain degree of rigidity. The rigidity of a line of joined modules can be increased by performing additional joining means such as welded lugs connecting the flat faces of two adjacent modules or cables 32.

If a module is subjected to a certain bending stress, it is advantageous to replace the thin outer sheets, or at least one of the sheets of the module which acts as the baseplate of a member subjected to bending, by thicker sheets 3*a* (FIG. 2).

According to another aspect of the invention, and in order to install a line of modules in flowing water, the invention provides for equipping the organs with temporary floating means. In a preferred embodiment, these floating means, as seen in FIGS. 3 and 4, are balloons 9 in an expandible plastic material such as rubber or neoprene, fitted with an inflation valve 10 and a means to puncture the envelope, such as an explosive bolt 11 which can be controlled electrically by means of a wire 12 connected to an appropriate detonating device, or by any other means.

Experience demonstrates that it is not necessary to inflate the balloons 9 hard to obtain a contact which is adequate for any slippage risk to be eliminated. In particular, in the case of tubular elements with triangular base, as seen in FIG. 4, the contact between the wall of the balloon 9 and the bent sheet 4 is made along only part of each side of the triangle but nevertheless offers an adequate contact to withstand the lift stress of the corresponding tubular element. In effect, when a balloon 9 is installed in each tubular element 2, the weight to be borne by the balloon 9 is minimum. On the contrary, the contact between the wall of the balloon 9 and the sheet 4 can, if desired, be considerable: it suffices to inflate the balloon 9 hard.

Figure 3:
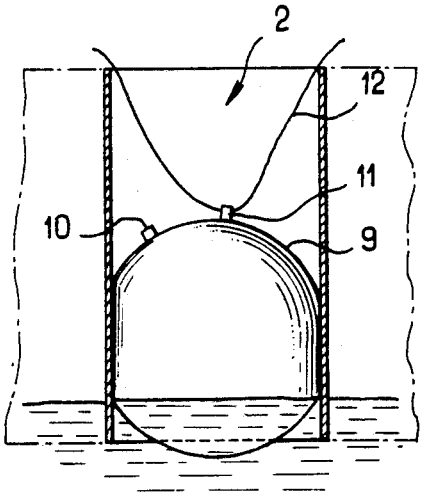
FIG. 3 is a diametrical cross-sectional view of a tubular element with a circular base equipped with floating means (not sectioned) and set on water.
Figure 4:
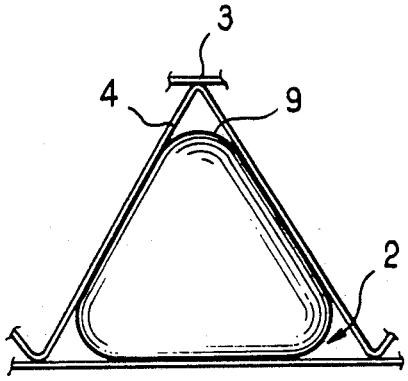
FIG. 4 is a top view of a tubular element in the form of a prism with triangular base equipped with floating means.

The balloon 9 is preferably intalled at the base of the tubular element, as shown in FIG. 3, and thus affords buoyancy with a minimum of draught of the module, when the said module is installed in the river.

It will be noted that it is not essential to provide all the tubular elements 2 with balloons. In effect, buoyancy is ensured by the immersion of part of the balloon only. As long as a small number of balloons provide for the buoyancy of a module, the other tubular elements can remain empty. Nevertheless, it is preferable to schedule a balloon in each element because this arrangement makes it possible to obtain minimum draught.

Although the preferred buoyancy means is a balloon, other means are also schedules according to the invention to ensure the temporary buoyancy of the organ. In particular, the bottom or top of the tubular elements 2 can be closed temporarily by means of a flexible (sheet of plastic material) or rigid (sheetmetal) membrane. A floating belt can also be scheduled around the outside of the module and maintained against it by any appropriate means, the aim being preferably to eliminate all the buoyancy means of the modules simultaneously so that the said modules can be immersed together as will be seen further below.

When the organs are built, it is possible to build a slip on the edge of the river on which operations will be performed. It is designed so that its foundation can, at will, be in the dry or covered by a few centimeters of water. When the welding of an module is completed, its buoyancy is achieved, for example, by installing the balloons. When balloons are used, they must be installed and inflated to a pressure providing for adequate contact when the module is in the dry, otherwise the balloon would rise inside the tubular element 2 as soon as the module is immersed and would no longer play its role. In effect, if a balloon were to be inflated when immersed, it would rise to the surface of the water as soon as inflation starts, in other words before the balloon reaches an adequate size to exert contact on the walls.

The water is then allowed to cover the slip so that the module can be moved toward the river. The slip is then dried out so that work on the following module can be carried out conveniently.

According to another embodiment, a submersible pontoon is scheduled equipped with ballasts and moored along a bank. When an module has been built and fitted with its floating means, the water is allowed to flow into the ballasts and the pontoon in slightly submerged, its sinking being controlled by chains moored to the bank and by independent floats. After the module has been removed, the water is again eliminated from the ballasts and the pontoon rises to the surface, ready for the construction of another module.

Figure 5:
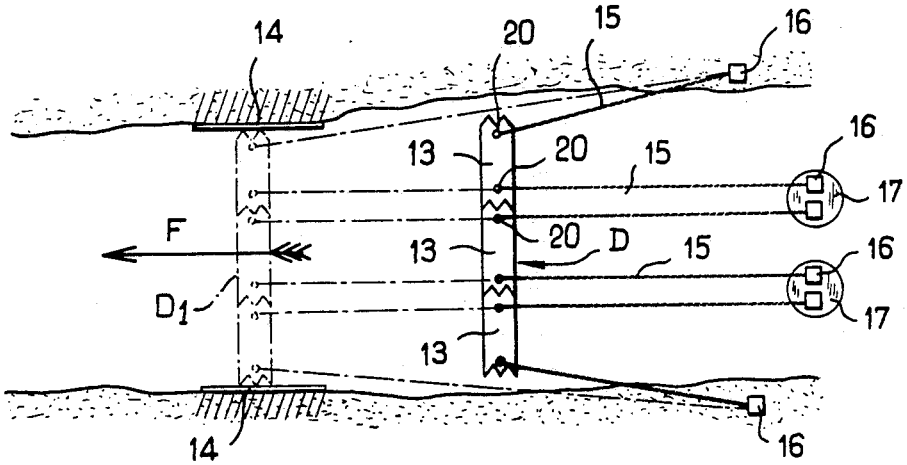
FIG. 5 is a schematic top view of a river in which three joined modules are being installed.

FIG. 5 shows a schematic top view of a river on which three joined modules 13 equipped with their floating means are maintained upstream of the abutments 14 between which the closure will be performed. Upstream of the abutments, the width of the river must be greater than the distance between the abutments so that the organs can be aligned and assembled. In order to avoid a drift in the current, represented by an arrow F, cables are attached at one end to bollars 20 integral with the module, the cables furthermore being wound round winches 16 installed on the bank of the river or on temporary submerged platforms 17, supported by piles driven into the river. The modules 13 are thus held in line to achieve a floating line of modules D, whose length is substantially equal to the distance between the abutments 14.

For its installation, the floating line of modules D is allowed to drift parallel to itself along F under the effect of the current giving slack to the mooring cables 15, until the line of modules arrives at D1 above the sinking site, after which all the balloons are punctured simultaneously.

Figure 6:
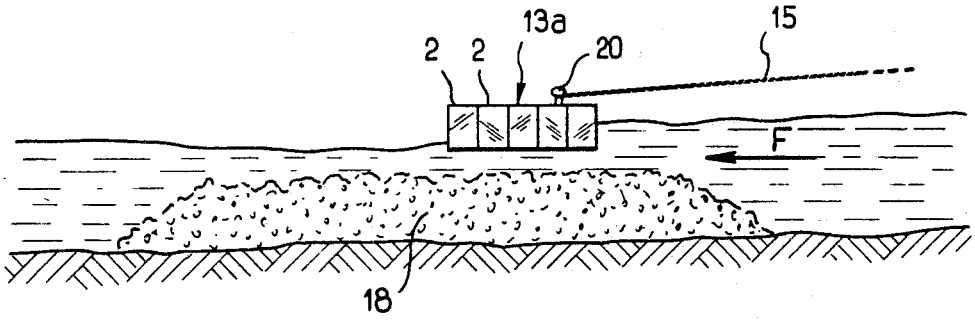
FIG. 6 is a schematic sectional view of a river after a first line of modules has been installed.

Reference will now be made to FIG. 6 which shows a schematic sectional view of a river with the closure being performed. A base 18 is first of all put in place on the bottom of the river between the banks (not shown). This base 18 consists of rockfill of sufficient dimension to avoid being entrained by the current.

The base 18 must be extended downstream of the modules in place so that there is no risk of erosion being caused by the water running above their crest.

The horizontality of the base 18 is checked by means of a device called a "guillotine" consisting of a horizontal bar carried by two uprights, each of which is able to swivel in a vertical plane. Where applicable, local consolidation will be carried out if necessary. To level off the rockfill surface, use will advantageously be made of a type of harrow moved by cables. Once the base 18 is completed, one or several modules 13*a* in line are brought straight above the base 18 by slackening the mooring cables 15.

When the layer of modules 13*a* is straight above the base 18, the floating means are punctured simultaneously. In particular, experience shows that when an inflated balloon is punctured, deflation is not progressive but resembles a veritable explosion of the balloon, the tear initially started continuing at a very high speed. The line of modules sinks rapidly while remaining horizontal until the base of the tubular elements 2 comes into contact with the surface of the base 18. The line of modules 13*a* then provides a closure with a horizontal top over the entire width of the river and the tubular elements 2 can be progressively filled with a heavy material. The tubular elements 2 can be filled by any appropriate means using a pump dredger removing directly from the river bed small rockfill which will previously have been put in place or by floating cranes unloading barges containing the necessary materials, or by a cableway.

It could have been feared that the modules, even filled with rockfill, would be entrained by the current when rolling the rockfill of the base under them. Experience has shown that this is not the case.

Making a closure over a large height would not be possible with a single row of modules. According to an embodiment, after the installation and filling of a first row or layer of modules, it is possible to install in the same way a second line of modules on top of the first, the second line of modules being a little longer than the first if the valley has a V-shaped section. To avoid erosion of the river bed downstream of the closure, it might be preferable to divide the height of the head into series of elementary heads offset with respect to each other from upstream to downstream.

Figure 7:
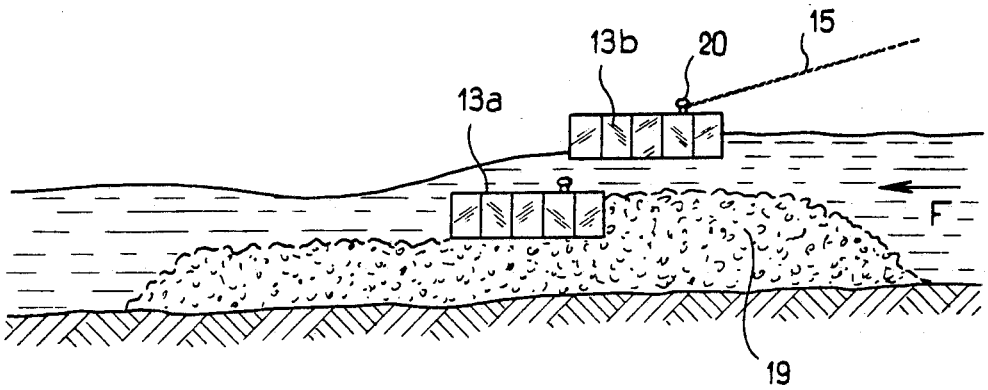
FIG. 7 is a schematic sectional view of a river after a second line of modules has been installed.
Figure 8:
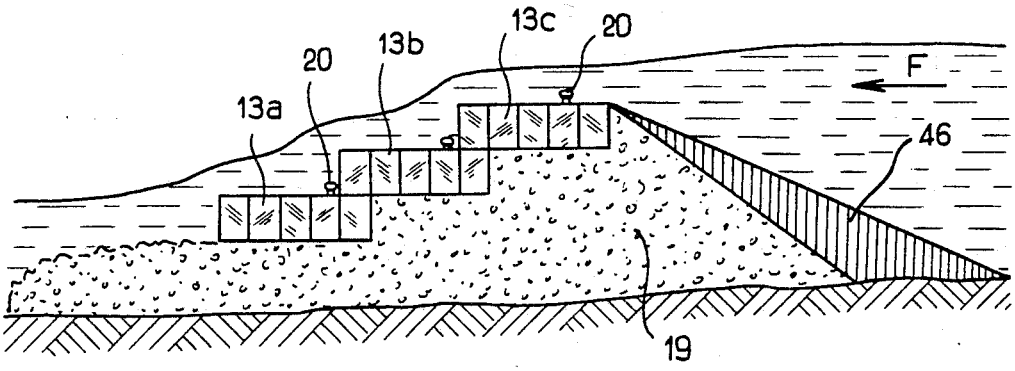
FIG. 8 is a schematic sectional view of a river comprising a closure according to the invention.

This series of elementary heads is obtained as shown in FIG. 7 by building up a fill 19 upstream of the first line of modules 13 after filling it with rockfill. The surface of the backfill extends upstream the upper surface of the first line of modules and thus constitutes a reception surface for a second line of modules 13*b* positioned, installed and filled in the same way as the first line of modules. A new backfill can be placed upstream of the second line of modules, and the structure shown in FIG. 8 is then obtained, by adding a third line 13*c*, these various lines 13*a*, 13*b*, 13*c* being offset with respect to each other starting from the bottom of the closure towards its top.

It is thus possible to superimpose a series of lines of modules and achieve a closure substantially raising the level of the river and thus even forming a barrage. On its upstream face, this barrage comprises preferably a waterproofing lining, for example a clay block 46.

When the barrage is completed, the water can flow over the top of its crest.

It will frequently occur that a water catchment intended for example to supply a hydroelectric powerstation, is located at an elevation which is lower than that of the crest of the structure. By stopping the work during high-water periods, the upper part of the structure can be built in the dry.

Figure 9:
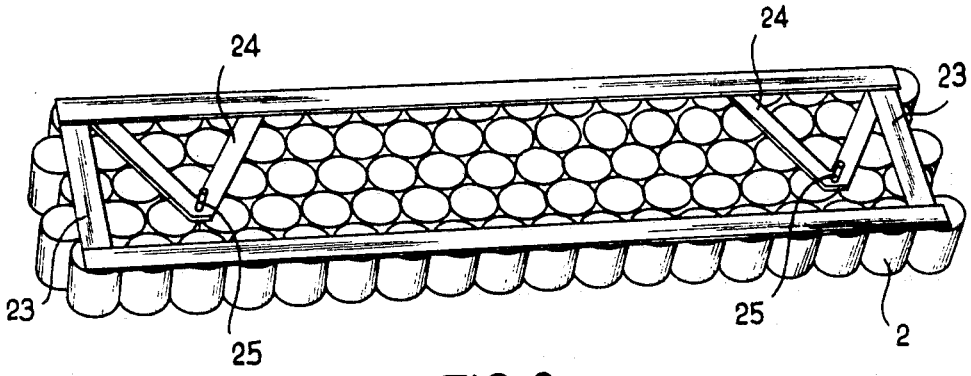
FIG. 9 is a perspective view of a module comprising cylindrical tubular elements with circular base.

The alternative in FIG. 9 shows that the module furthermore comprises a metal frame 23 serving as a circulation path.

Finally, the module comprises V-shaped braces 24 installed in the upper plane of the module and secured to the tubular elements, for example by welds. The braces 24 thus distribute the stresses withstood by the mooring bollards 25 over several tubular elements 2.

Such braces are not necessary with modules having triangular elements, because the stress exerted at a connection point is directly transmitted to six sheets which afford a satisfactory distribution of the stresses in the body of the structure.

In another version where several lines of modules are superimposed, if bollards 20 or 25 are used to hold the modules before their sinking, these bollards can be set back with respect to the edge of the module as is seen in FIGS. 2, 5, 6, 7, 8 and 9. These bollards also act as stops as can be seen in FIG. 8.

Figure 10:
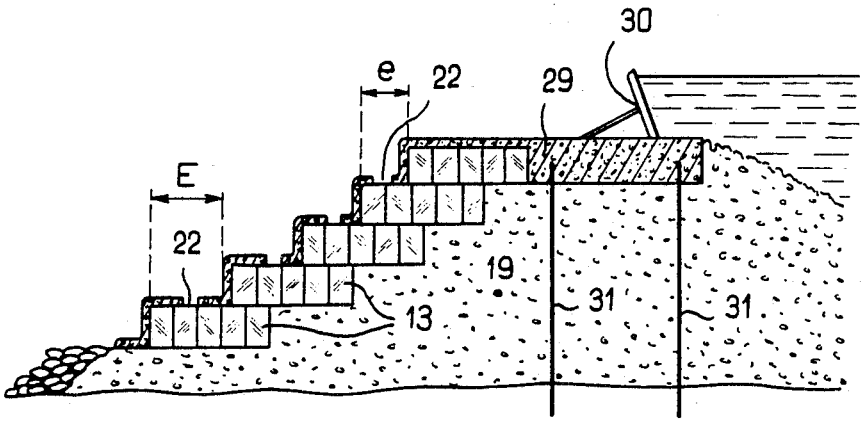
FIG. 10 is a schematic sectional view of a barrage made with modules according to the invention.

FIG. 10 shows a schematic sectional view of a barrage made using organs in accordance with the invention.

The barrage consists of a series of organs 13 superimposed and offset with respect to each other.

At its upper part, a crest has been made consisting of a concrete slab 29 on which a gate 30 is installed.

The question of height and width dimensions of the various staircase steps is important. It is in effect desirable that the flood water flows without acceleration on the downstream wall of the structure. Under such conditions, one could dispense with scheduling an energy dissipation device downstream. It is nevertheless desirable that the last step be flooded under the level of the downstream reservoir.

Possibly, the steps exhibit different widths, in particular the bottom steps can have a width E greater than the width e of the stop steps, as shown in FIG. 10.

According to an alternative, the modules have a progressively greater height from the bottom towards the top of the structure so that the slope of the downstream face increases as the structure rises.

The materials used for making the modules can be diverse. In particular, to avoid corrosion problems, the steel sheets can be metal-coated or be in steel having low-oxidation properties.

According to an alternative, a concrete lining is also scheduled on the steps in order to prevent the water falling from the upper level from entraining part of the materials which fill the modules, but it is then desirable to provide spaces 22 allowing drainage of the lining by the water rising through the lines of modules. Alternatively, filling of the upper part of the elements of the modules is carried out with sufficiently heavy rockfill, some of which is maintained by the concrete.

Figure 11:
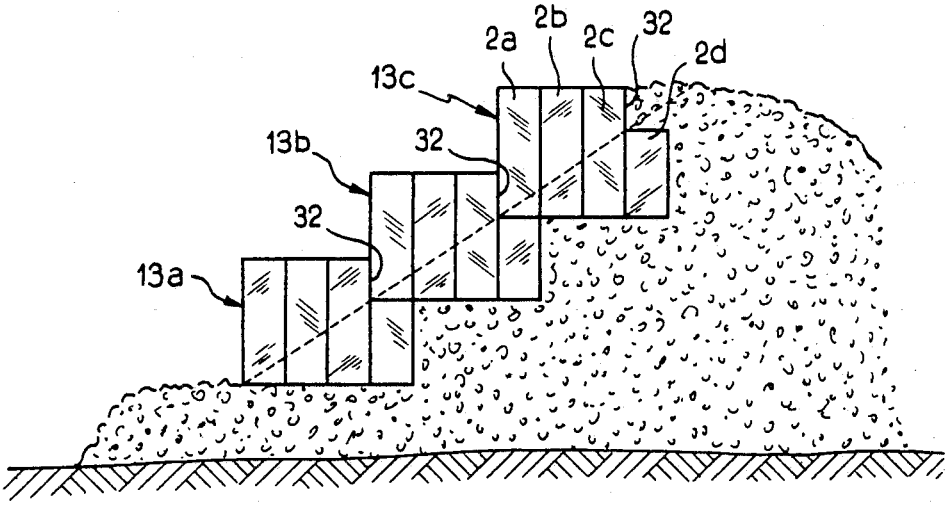
FIG. 11 is a sectional view of a closure consisting of another embodiment of the modules.

In the alternative of FIG. 11, each of the modules of the lines of modules 13*a*, 13*b* and 13*c* includes three rows of elements 2*a*, 2*b* and 2*c* of similar height and a row of elements 2*d* of a smaller height which thus form, on the upper surface of the module, a setback 32 extending the length of the upstream edge of the module.

When the modules are put in place, the lower downstream edge of each organ abuts on the setback 32 of the module located on the row immediately below, in such a way that the resultant of the forces to which the module is subjected is directed substantially along the line joining the base of the setbacks 32 and which is shown by a broken line in FIG. 13.

The slope of this line can be varied by varying the ratio of the number of rows of elements 2 of large height to the number of rows of elements 2 of small height or by varying the depth of the setback.

Furthermore, the setback 32 constitutes a stop similar to the bollards 20 and therefore facilitates the placement of the successive lines of modules in a perfectly aligned assembly.

Figure 12:
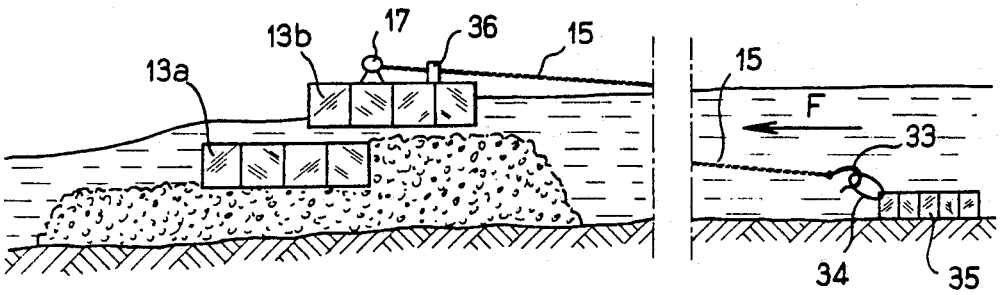
FIG. 12 is a sectional view of a river during the installation of a line of modules, according to a different method.

An alternative of the installation method described with reference to FIGS. 6 to 8 is shown in FIG. 12. The section is partially truncated to allow the elements concerned by the alternative to be shown while remaining within the limits of the figure.

According to this alternative, the modules are previously assembled in line as before. Nevertheless, the winches 17 are this time fitted to the modules themselves. The end of the cables 15 opposite that secured to the winches 17 is provided with a hook 33 engaged in a loop 34 integral with a deadweight 35 such as an module according to the invention dropped in place and filled with rockfill upstream of the closure site. In the same way as before, when the modules are aligned as a floating closure across the river flow, slack is given to the cables 15 to bring the line of modules straight above its sinking site.

The modules are then held in place at the chosen site by means of clamps 36 secured to them and which clamp the cables 15. The winches 17 are then disassembled and returned to shore and the modules are then dropped in place and filled with rockfill in the same way as before. After anchoring the modules, the cables 15 can be recovered or, on the contrary, be left in place to act as anchor ties as shown in FIG. 13.

According to this method, as the lines of modules 13*a*, 13*b* and 13*c* are put into place, they are connected to an module 35*a* previously installed and filled with rockfill and each of the anchoring cables, 15*a* to 15*c* respectively, has been kept in place so that the lines of modules 13*a* to 13*c* are stabilized in position not only by the weight exerted on them but also by the pull on the cables 15 to 15*c* connected to the deadweights 35*a* and 35*b*. To avoid too great an angle of the cables 15 with the horizontal, it is advantageously scheduled that after having installed several modules, the upstream fill is extended as far as the first deadweight 35*a* which thus becomes integral with the structure, before putting a second deadweight 35*b* in place connected to the modules 13*d* to 13*f* by means of cables 15*d* to 15*f* respectively.

This alternative makes is possible to build structures having a downstream face with a very great slope without there being a risk of it caving in.

Figure 13:
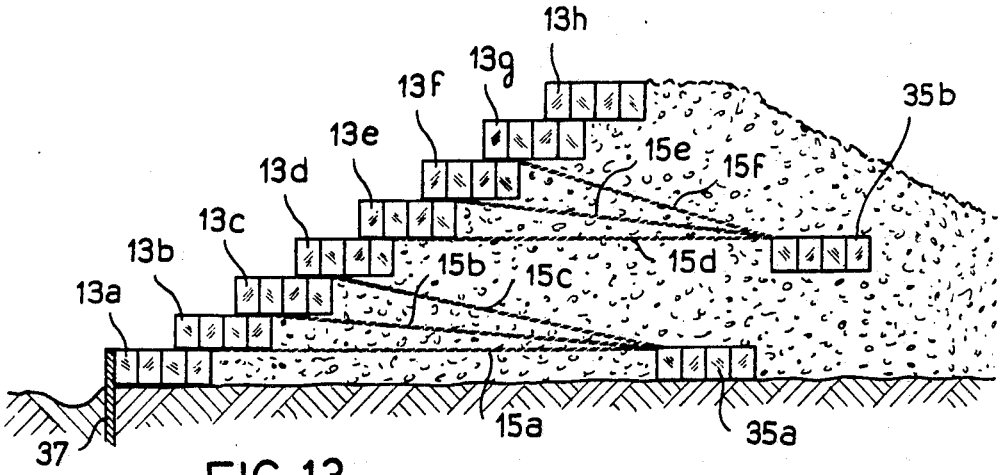
FIG. 13 is a sectional view of another embodiment of a closure.

As can be seen in FIG. 13, provision has also been made for a series of sheetpiles 37 driven into the bed level with the downstream edge of the lower line of modules and which constitutes a sheetpile closure preventing erosion of the structure.

Figure 14:
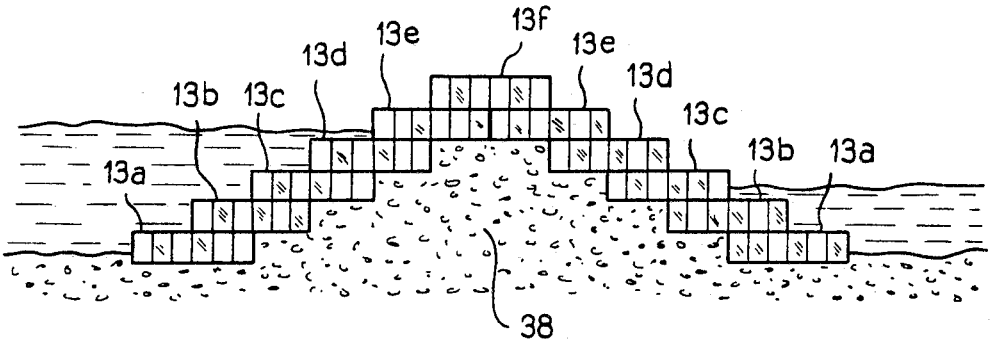
FIG. 14 is a schematic sectional view of a coastal structure.

FIG. 14 shows the method according to the invention of an embankment at sea of the type which can be used for tidal powerstations.

In this case, the identical lines of modules 13*a* to 13*c* are arranged like a staircase symmetrically with relation to the embankment to cover it, one line of modules 13*f* forming the final cover at the top of the embankment. Hence, it is possible to obtain an embankment by using very loose material such as sand, this embankment nevertheless offering sides with a steep slope and decreasing as a result the total volume of the embankment.

The same replacement of a very gentle bank by a staircase of modules is recommended when an artificial island is to be built. In effect, in this case as in that of the embankment, it is sought as far as possible to reduce the volume of sand used.

Figure 15:
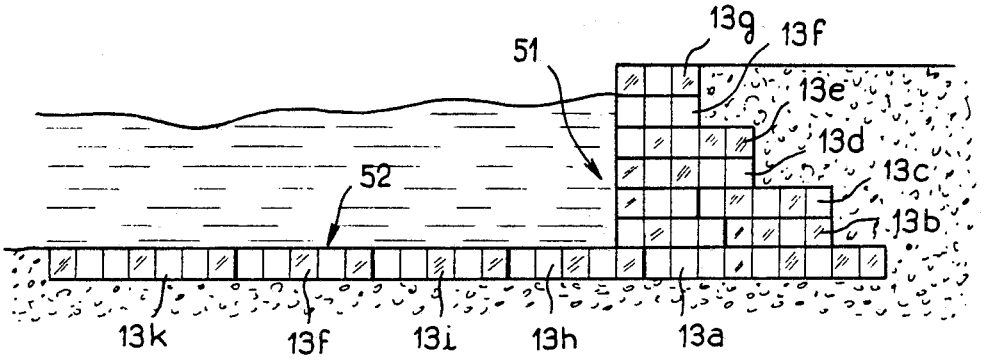
FIG. 15 is a schematic sectional view of a quay wall.

FIG. 15 illustrates the method according to the invention of a vertical quay wall exposed to direct attack by the sea. The fast water variations in front of the vertical wall lead to the production of very violent horizontal currents in front of the structure so that erosion, harmful for the stability of the wall itself, can occur.

In the case shown, a series of lines of modules 13*a* to 13*g* are superimposed with one of their edges straight above the others in order to constitute a continuous vertical wall 51.

According to the advantageous method shown, the wall is extended in the offshore direction by a slabbing 52 formed by lines of modules 13*h* to 13*k* laid on the sea bed next to each other at the same level and constituting indivisible blocks of several hundred tons providing strength to each other.

Figure 16:
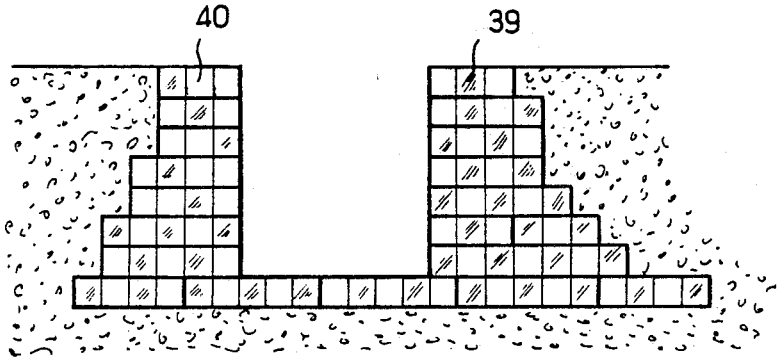
FIG. 16 is a schematic sectional view of lock chamber walls.

To build (FIG. 16) a lock with two vertical lock chamber walls 39 and 40, use can be made of modules with triangular elements as described with reference to FIG. 2. The visible side of a lock chamber wall consists of joined rectangular sheets. Assuming the structure is built in the dry, it is inexpensive to weld the sheets to each other to obtain a perfectly watertight structure. In this case, when making the modules preference is given to a grade of steel which is particularly resistant to corrosion and to the wear caused by the contact of boats. To better withstand the impacts from them, whcih are inevitable, particularly near the heads, the elements located immediately in contact with the sheets constituting the face could be filled with concrete and not with heavy materials.

Figure 17:
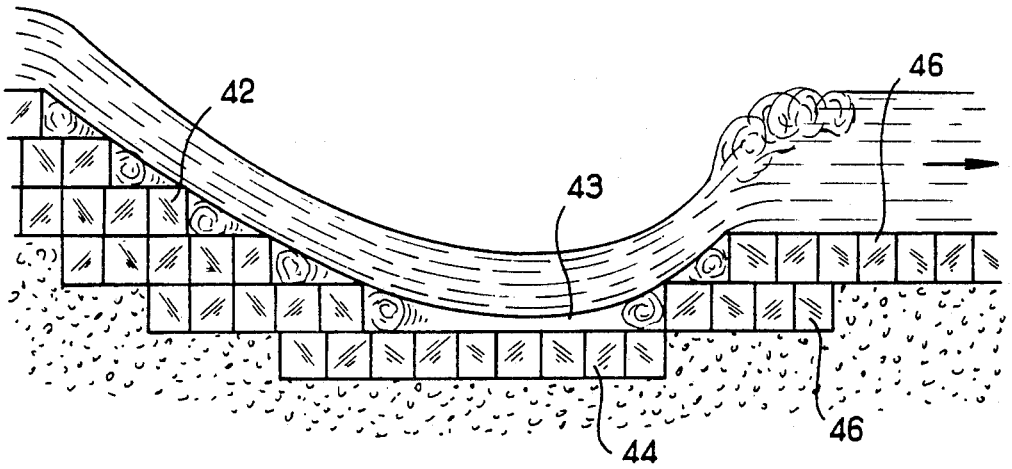
FIG. 17 is a schematic sectional view of a scour hole downstream of a dam.

FIG. 17 is the transverse section of the downsteam portion of a weir 42 and the scour hole 43 which usually follows it. It is in this hole, the depth of which downstream of some natural waterfalls can reach a hundred meters or so, that the energy produced by the fall is dissipated in eddies. A similar scour phenomenon occurs downstream of certain dams.

To limit the deepening of the hole, this hole is sometimes completely lined with masonrywork. In other circumstances, its deepening is sometimes limited by the use of very large rockfill.

Within the scope of this invention, the bottom of the hole 43 is protected by slabbing 44 comprising one or several lines of modules joined together along a layer near the structure 42 followed by one or several modules 46 in a rising staircase fashion which break the flow so that it is no longer torrential when it leaves the scour hole 43.

Figure 18:
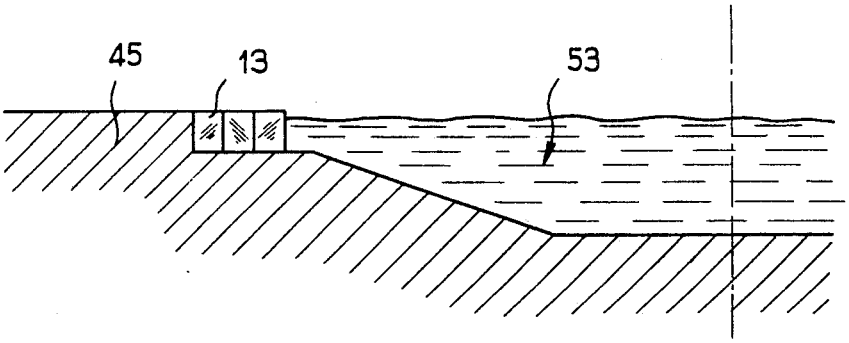
FIG. 18 is a partial schematic sectional view of a ship canal.

FIG. 18 illustrates a ship canal 53 the banks of which are protected against lapping resulting from the passage of ships by a continuous line of modules 13 embedded in the bank 45.

The preceding nonlimitative examples of the method show that the prefabricated civil engineering structure according to the invention can easily be employed for building numerous structures, remarkable by the simplicity and speed of erection, ruggedness and low cost of the means used.

Among the applications for which it has not been considered necessary to illustrate with figures, mention can be made of the use of one or several lines of modules to make the structure known as a bottom sill.

It is known that following modifications by engineers to the plan layout of certain rivers, modifications such as the shortening of the layout or the concentrating of water in a single bed, there is a risk of bed deepening. A continuous deepening is noted in particular in some non-channelled parts of the Rhine. It is sometimes considered necessary to combat this phenomenon which could continue for tens or even hundreds of years.

The construction of bottom sills is one of the methods which can be used.

A few lines of modules stretching from one bank to the other of the river would represent a very economical solution. In such a case, it might even be possible to dispense with filling the orifices with heavy materials because the bed load of the river could itself, at least partially, do the filling.

Similarly, it could happen that, either to protect the river bed or to perform certain work at sea, it is necessary to lay a blanket of modules on the bottom. Such an operation would be particularly easy to perform and it could include the following steps:

First the blanket would be made by rigidily assembling together a certain number of modules floating on the surface of the water. A certain number of orifices will be filled completely by balloons, whereas the others will remain empty.

In the empty orifices, a certain number of weights will be placed, each of which will be maintained by a rope with a hook at its end secured to the upper part of a sheet.

A certain number of anchoring cables will be used, for example at the four corners of the blanket if it is rectangular.

Total immersion will take place after a sufficient number of ballasting weights have been put in place. It will be controlled by means of cables.

As lowering proceeds, the volume of the balloons will decrease owing to the compression of the balloons by the increasing pressure of the water, so that a certain number of ropes supporting the ballasts will have to be severed.

When the blanket is located at a small distance from the bottom, assumed to be roughly horizontal, it will have to be positioned above its exact sinking site. This operation will be very easy because it will take place without contact, just like the movement of a ship in calm water. Frogmen will moreover be able to use small submarine motors similar to those they are accustomed to using when moving around.

This invention is not limited to the examples of the method which have been described but can be the subject of alternative embodiments which will be apparent to those skilled in the art. In particular, the tubular elements could take on various forms, for example square or hexagonal sections.

Although the invention has been described in connection with substantially rectilinear modules, it will be understood that the tubular elements can be joined so that curved modules as seen from above can be made, in such a way that a curved closure will be achieved and a certain arch effect will thus be obtained.

What is claimed is:

1. A device for constructing a civil engineering structure across a water flow, said device comprising a series of modules joined to each other and disposed across said water flow, each module being constituted by several rigid tubular elements joined to each other along their lateral faces and being substantially vertical, each tubular element being open on both ends, wherein each module comprises floating means to temporarily ensure a buoyancy of said module, each floating means being in module-supporting relation with the module, and means to eliminate simultaneously the buoyancy of the floating means to ensure a simultaneous sinking of all the modules in the water.

2. A structure as claimed in claim 1, wherein said tubular elements are made from a thin sheet of rigid material.

3. A structure as claimed in claim 1, wherein said floating means consist of inflatable balloons (9) placed inside said tubular elements.

4. A structure as claimed in claim 3, said eliminating means comprising means (11) to ensure the simultaneous puncturing of all the balloons.

5. A structure as claimed in claim 4, wherein the means to ensure the puncturing of the balloons comprise explosive bolts (11) placed on the floating means and actuated remotely.

6. A method for building a civil engineering structure across a water flow comprising the following steps:

installing across the water flow a series of floating modules, each module being constituted by several rigid tubular elements joined to each other along their lateral faces and being substantially vertical, each tubular element being open on both ends, floating means to temporarily ensure a buoyancy of said modules, said floating means being in module-supporting relation with each module, eliminating simultaneously the buoyant force between the modules and the floating means to ensure a simultaneous sinking of all the modules in the water, and filling the tubular elements of each module with heavy material.

7. A method according to claim 6 comprising a preliminary step of construction, on the bottom of the river, of a rigid base (18) with a substantially flat surface adapted to receive the modules.

8. A method as claimed in claim 7 wherein said series of modules is placed transversely to river flow and secured by mooring cables (15) wound on winches (16) placed upstream of the sinking site, and allowing the floating line of the modules to drift under the effect of the river flow by controlling a payout of the mooring cables (15) until the floating line of the modules is directly above the rigid base.

9. A method as claimed in claim 8, wherein several lines of modules **(13*a*, 13*b*, 13*c*)** are placed successively so as to superimpose them at least in part, each line of modules being filled with heavy materials before installation of a following line of modules.

10. A method as claimed in claim 8, wherein a fill (19) is placed upstream of each line of modules after it has been filled, and in that the successive lines of modules **(13*a*, 13*b*, 13*c*)** are installed so that they are offset with respect to each other.

11. A method as claimed in claim 10, wherein after installation and filling of the modules, a part (21) of free upper ends of the tubular elements (2) is concreted.

* * * * *

UNITED STATES PATENT AND TRADEMARK OFFICE

CERTIFICATE OF CORRECTION

PATENT NO. : 4,661,014

DATED : April 28, 1987

INVENTOR(S) : Jean AUBERT

It is certified that error appears in the above—identified patent and that said Letters Patent is hereby corrected as shown below:

In the heading of the patent, Item 73, change "Groupement d'Interet Economique" to --Groupement d'Interet Economique named: Hydro-Orgue--.

Signed and Sealed this

Twenty-fifth Day of August, 1987

*Attest:*

DONALD J. QUIGG

*Attesting Officer*

*Commissioner of Patents and Trademarks*